US007178174B2

(12) United States Patent
Söderström

(10) Patent No.: US 7,178,174 B2
(45) Date of Patent: Feb. 20, 2007

(54) MEN'S UNDERWEAR WITH AN ADJUSTABLE SUPPORT SLING

(76) Inventor: Peter Söderström, c/o con Gerber St. Eriksterassen 72A, S-112 34 Stockholm (SE)

( * ) Notice: Subject to any disclaimer, the term of this patent is extended or adjusted under 35 U.S.C. 154(b) by 0 days.

(21) Appl. No.: 11/227,261

(22) Filed: Sep. 16, 2005

(65) Prior Publication Data

US 2006/0096006 A1 May 11, 2006

Related U.S. Application Data

(63) Continuation of application No. 10/433,457, filed on Jun. 3, 2003, now abandoned.

(30) Foreign Application Priority Data

Dec. 8, 2000 (SE) ..... 0004548

(51) Int. Cl.
*A41B 9/02* (2006.01)

(52) U.S. Cl. ..... 2/403; 2/78.1; 2/78.3; 2/404; 2/405

(58) Field of Classification Search ..... 2/405, 2/403, 78.2, 78.3, 404, 67
See application file for complete search history.

(56) References Cited

U.S. PATENT DOCUMENTS

| | | | | | |
|---|---|---|---|---|---|
| 642,920 | A | * | 2/1900 | Potts | 602/69 |
| 2,050,410 | A | * | 8/1936 | Baer | 602/69 |
| 2,254,863 | A | * | 9/1941 | Weihe | 602/69 |
| 3,037,503 | A | * | 6/1962 | Ravaschieri | 602/69 |
| 3,207,155 | A | * | 9/1965 | Cullen | 602/67 |
| 3,459,181 | A | * | 8/1969 | Mann | 602/67 |
| 3,499,443 | A | * | 3/1970 | Scheerer | 602/68 |
| 3,511,234 | A | * | 5/1970 | Larson | 602/67 |
| 3,621,846 | A | * | 11/1971 | Leham | 602/67 |
| 4,173,976 | A | * | 11/1979 | Bloomquist et al. | 602/67 |
| 4,195,630 | A | * | 4/1980 | Connery et al. | 602/67 |
| 4,471,772 | A | * | 9/1984 | Miller, Jr. | 602/67 |
| 4,526,167 | A | * | 7/1985 | Ebenal et al. | 602/70 |
| 4,660,551 | A | * | 4/1987 | Nishimura | 600/41 |
| 4,702,239 | A | * | 10/1987 | Ichikawa | 602/67 |
| 4,961,419 | A | * | 10/1990 | Tribble et al. | 602/70 |
| 5,029,345 | A | * | 7/1991 | Angheluta et al. | 2/403 |

(Continued)

FOREIGN PATENT DOCUMENTS

| | | |
|---|---|---|
| FR | 2567001 | 1/1986 |

(Continued)

*Primary Examiner*—Gary L. Welch
*Assistant Examiner*—Richale L. Haney
(74) *Attorney, Agent, or Firm*—Dickstein Shapiro LLP

(57) ABSTRACT

The invention relates to a pair of man's trousers which is adapted for use by preferably sportsmen and by other active persons, comprising a waist portion (2) connected to back and front portions (3, 4), which merged into each other or are interconnected at a crotch (5). The front portion (4) includes a pocket (7) sewn to its inner side and having an upper, inward directed, free edge portion (8), the vertical position of which can be adjusted relatively the waist portion (2), preferably by means of an adjustment member (9) extending from the waist portion (2), preferably with the aid of adjustment means (9) extending from the waist portion (2), for the purpose of adaptation to the location of the genital organs of the user and/or to the type of sport which the wearer is practicing.

9 Claims, 1 Drawing Sheet

U.S. PATENT DOCUMENTS 5,226,179 A * 7/1993 Choi ..... 2/403
5,274,854 A * 1/1994 Wenner et al. ..... 2/403
5,283,912 A * 2/1994 Chung ..... 2/403
5,524,298 A 6/1996 Plunkett
5,547,466 A * 8/1996 McRoberts et al. ..... 602/70
5,647,065 A * 7/1997 Richerson ..... 2/403
5,718,003 A * 2/1998 Gwinn ..... 2/405
5,870,779 A * 2/1999 Heron ..... 2/403
6,038,703 A * 3/2000 Chung ..... 2/403
6,061,840 A * 5/2000 Alligator ..... 2/403
6,132,412 A * 10/2000 Jones ..... 604/400
6,557,182 B2 * 5/2003 Taylor ..... 2/403

FOREIGN PATENT DOCUMENTS

GB 2060356 A * 5/1981
WO WO-9839981 9/1998

* cited by examiner

MEN'S UNDERWEAR WITH AN ADJUSTABLE SUPPORT SLING

This application is a continuation of U.S. patent application Ser. No. 10/433,457, filed Dec. 7, 2001, now abandoned, which was originally filed as Swedish patent application number 0004548-4 on Dec. 8, 2000. The entirety of these applications is hereby incorporated by reference herein.

FIELD OF THE INVENTION

The present invention relates to a pair of men's trousers which is preferably adapted for use by sportsmen and comprises a waist portion connected to front and back portions which are interconnected or merge into each other at a crotch.

BACKGROUND

The trousers used today and available in the market in the shape of men's underwear or sport trousers do in many cases include inside trousers shaped like a, perforated lining through which moisture can pass. In certain cases this lining is also designed to offer an action supporting the genitals of the man, above all his scrotum. In addition to those prior art trousers, especially those adapted for sport use, there exist specially shaped trousers or girdles intended to support the "package" and/or to retain it in the desired position. The disadvantages of those previously known arrangements are that the lined trousers fail to keep all of the genital unit in its proper location without the aid of further garments/products. Also, it is inconvenient and time-consuming to apply the above mentioned details to secure the positioning thereof. Those previously known solutions concern what could be called scrotum bags the function of which is to push the scrotum up against the stomach. The sportsmen having a special need of a solution in this area are for example marathon racers and sprinters.

SUMMARY

The object of the present invention is accordingly to provide a new type of men trousers which solves the above mentioned problems, can easily be manufactured and in an efficient way retain all of the genital unit in position without any need of additional garments/products. The features characterizing the invention are set out in the subsequent claims.

Thanks to the invention there has now been provided a new type of men's trousers, which satisfies this purpose and also can be manufactured in a cheap and convenient way. Such a pair of trousers does, especially for active persons and for sportsmen of a more professional character, constitutes a solution which by means of a pocket sewn to the trousers keeps all of the genital unit in position. Further, due to the fact that the pocket is sewn on the trousers so as to provide a special adjustment function, it becomes possible to use the same type of trousers by all sportsmen irrespective of the type of sport they are practicing and the stiffness requirements, and by different individuals irrespective of their configuration as far as the size and the location of the genital organ. The adjustment function of the pocket makes it possible for, e.g., a marathon racer to adjust the elastic governing the vertical position of a pocket to a lower pressure than that used by a 100 meters sprinter. Generally speaking, the pressure on the pocket can be adjusted to match different activities. The pocket consists of an elastic material, which makes it possible also to create a push up effect on the unit. Consequently, the essential features of the invention are that the pocket keeps all of the unit spaced from the body/the legs/the stomach. In this way an air slot is created between the genital organ and the rest of the body. The air slot provides cooling/temperature control, which, among other things, gives a higher fertility and protects the skin from irritation. This type of trouser according to the invention is especially suitable for different sportsmen, where the need for spacing the unit is varying in response to the actual physical activity. According to the prior art the genital unit contacts a concave surface, but according to the invention there is instead a flat supporting surface behind the unit, which generates a separating, temperature controlling effect.

Consequently, a pair of trousers according to the invention provided with its pocket can in a safe way "anchor" the genital unit, and thanks to this allow a higher performance without limiting the freedom of movement, creating discomfort or in some other way reducing the performance of the sportsmen.

A preferred embodiment of the invention is described below, reference being made to the drawings.

DETAILED DESCRIPTION

Figure 1:
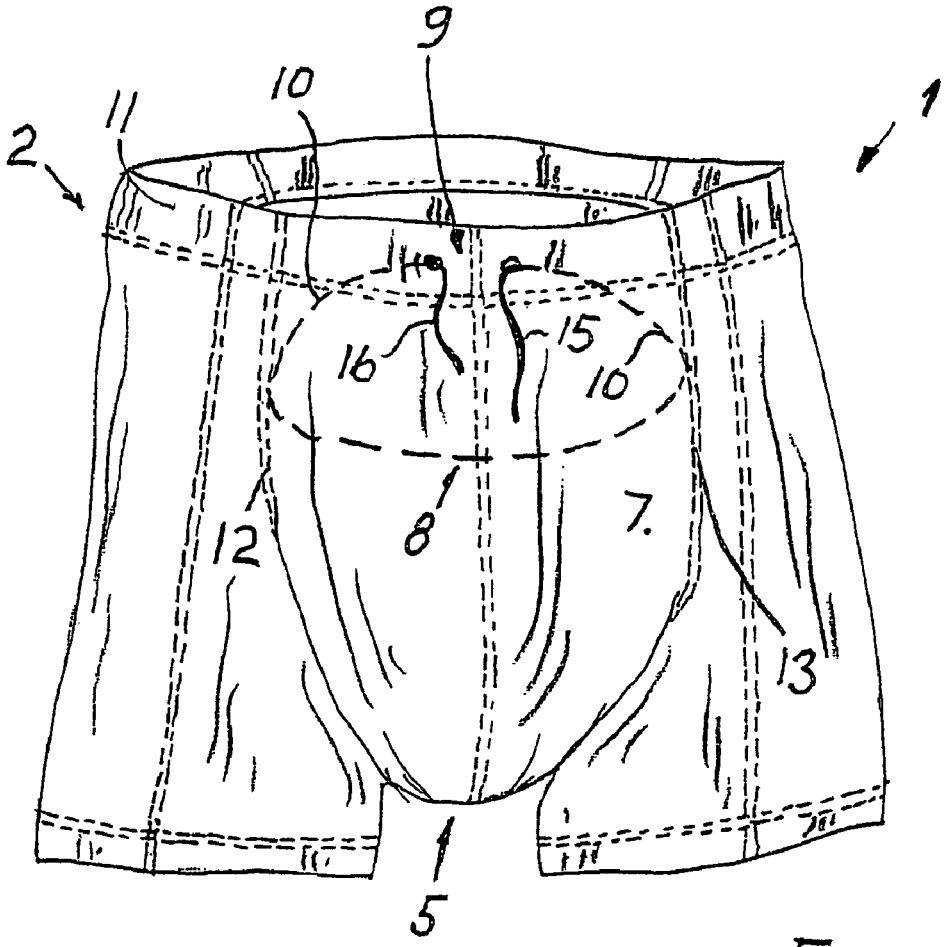
FIG. 1 is a schematic perspective view showing a pair of trousers according to the invention with a pocket sewn thereon, its inner free, upper edge portion being vertically adjustable.
Figure 2:
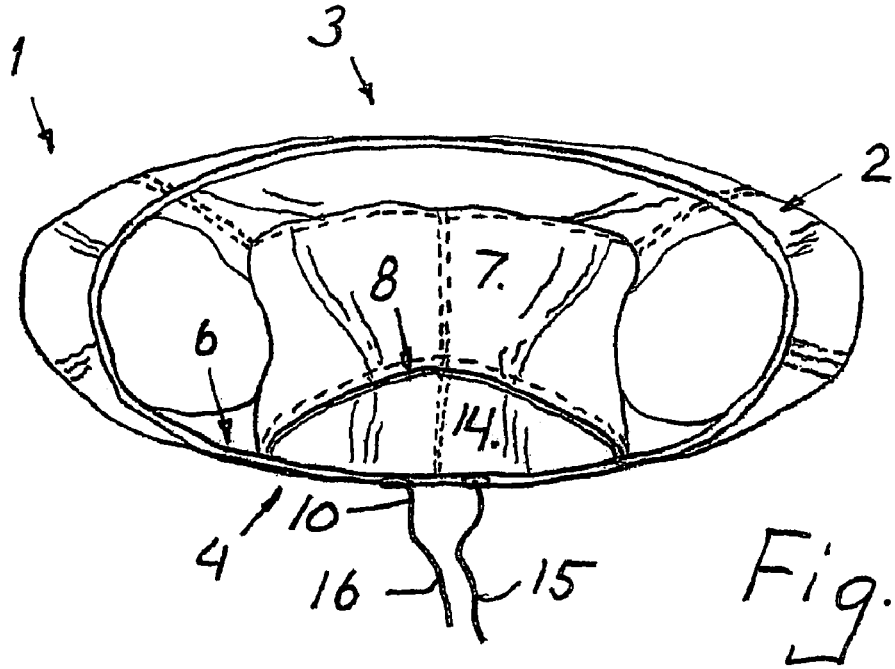
FIG. 2 is a schematic perspective view of the pair of trousers shown in FIG. 1, here illustrated in a top view.

As appears from the drawings, a pair of trousers according to the preferred embodiment of the invention includes a waist portion 2 connected to front and back portions 3, 4. These merge into each other and are interconnected at a crotch 5. The front portion 4 of the trousers 1 does at its inner side have a pocket 7 sewn thereon and comprising an upper, free edge portion 8, which when the trousers are in use, should be located behind and against the scrotum root between the legs of the wearer. The vertical position of the edge portion 8 can be adjusted relative to the waist portion 2. Preferably, this adjustment is made with the aid of adjustment means 9 and in response to the position of the genitals on the body and to the type of sport at issue. The front portion of the adjustable pocket 7 and, more specifically, the free edge portion 8 is, stated in other words, adapted to lift all of the unit, meaning both scrotum and penis, inside the trousers in a direction out from the body for the purpose of forming an air slot between the unit and the rest of the body/legs, stomach.

According to the exemplifying embodiment the adjustment means 9 is constituted by an elastic band 10 with the aid of which the free edge portion 8 can be tightened towards a waist band 11 in the waist portion 2, said band keeping the trousers in desired position on the user.

According the example illustrated the pocket is tight at its bottom but, naturally, pocket 7 can alternatively be opened at its bottom, which is a preferred structure because it keeps the pocket free from collected dust and other undesired particles. As appears from the drawing the upper, free end portion 8 of pocket 7 extends along a curved line inward in the trousers and the adjustment member 9 is located in the edge portion 8. The front portion 14 of the pocket 7 is constituted by the inner side 6 of the front portion 4 of the trousers. Alternatively, the front portion 14 of the pocket 7 can be constituted by a separate wall portion, so that a bag is provided inside the front portion 4. The bag, or pocket, 7 can also be manufactured in a heat-insulating material, which is suitable when the trousers are used during the winter time. Also, the pocket can be manufactured in a material having a low friction at the external side and a high friction on the internal side. The adjustment member 9 controlling the vertical position of the pocket 7 is, as has been mentioned above, preferably an elastic band 10. With the aid of some type of pulling hook in the waist band, its free ends 15 and 16 or a burdock strip band can be fixed in position in the waist portion 2. According to the example illustrated the sides 12, 13 of the pocket 7 are sewn to the inner side 6 of the front portion 4 of the pocket 7 in the larger part of the front portion 4 as extending vertically. The pocket 7 can suitably be made of a material that can be penetrated by air or moisture. This is to be preferred, especially when the trousers are to be used by sportsmen. Alternatively, the pocket 7 can be constituted by a material also being elastic, whereby a so called "push up" effect can be attained.

The invention claimed is:

1. Men's garment, comprising:

a waist portion connected to a back portion and a front portion, said back and front portions being merged at a crotch, wherein the front portion has an internal side;

a pocket affixed to said internal side of said front portion and configured to house both the penis and scrotum of a male wearer of said garment, said pocket comprising a free edge portion; and an adjustment member configured to adjust the vertical position of the free edge portion to the location behind and against the scrotum root of the male wearer and to thereby prevent all of the scrotum and the penis from contacting the skin of other body parts and wherein the front portion provides part of the structure of the pocket.

2. The garments of claim 1, wherein the adjustment member comprises an elastic band.

3. The garment of claim 1, wherein the pocket is open at a bottom thereof.

4. The garment of claim 1, wherein the adjustment member comprises a band which at its free ends can be fixed in position to the waist portion.

5. The garment of claim 1, wherein the sides of the pocket are sewn on the inner side of the front portion along the greater part of the front portion, extending vertically.

6. The garment of claim 1, wherein the pocket is manufactured in a material which can be penetrated by air and/or moisture.

7. The garment of claim 6, wherein the pocket is manufactured in a material also being elastic.

8. Men's garment, comprising:

a waist portion connected to a back portion and a front portion, said back and front portions being merged at a crotch, wherein the front portion has an internal side; and a pocket affixed to said internal side of said front portion and configured to house both the penis and scrotum of a male wearer of said garment and maintain said penis and scrotum spaced from the body of said wearer, said pocket comprising a free edge portion, said free edge portion being adjustable relative to the body of the wearer by an adjustment member within said free edge portion, said adjustment member being configured to adjust the vertical position of the free edge portion to the location behind and against the scrotum root of the male wearer and to thereby prevent all of the scrotum and the penis from contacting the skin of other body parts, wherein said pocket has an interior surface having a first friction and an exterior surface having a second friction, said first friction being greater than said second friction and wherein the front portion provides part of the structure of the pocket.

9. Men's garment, comprising:

a waist portion connected to a back portion and a front portion, said back and front portions being merged at a crotch, wherein the front portion has an internal side; and a bag configured to house both the penis and scrotum of a male wearer of said garment and maintain said penis and scrotum spaced from the body of said wearer, said bag comprising a wall portion adjacent said front portion and a free edge portion, said free edge portion being adjustable relative to the body of the wearer by an adjustment member within said free edge portion, said adjustment member being configured to adjust the vertical position of the free edge portion to the location behind and against the scrotum root of the male wearer and to thereby prevent all of the scrotum and the penis from contacting the skin of other body parts and wherein the front portion provides part of the structure of the pocket.

* * * * *